US005163983A

United States Patent [19]

Lee

[11] Patent Number: 5,163,983

[45] Date of Patent: Nov. 17, 1992

[54] ELECTRONIC AIR CLEANER

[75] Inventor: Joong-Hi Lee, Ansan, Japan

[73] Assignee: Samsung Electronics Co., Ltd., Rep. of Korea

[21] Appl. No.: 738,551

[22] Filed: Jul. 31, 1991

[30] Foreign Application Priority Data

Jul. 31, 1990 [KR] Rep. of Korea ..... 90-11734[U]

[51] Int. Cl.[5] ..... B03C 3/86

[52] U.S. Cl. ..... 55/104; 55/105; 55/139; 55/149

[58] Field of Search ..... 55/105, 14, 149, 139, 55/104, 113, 152

[56] References Cited

U.S. PATENT DOCUMENTS

| | | | |
|---|---|---|---|
| 1,481,970 | 1/1924 | Welch | 55/149 X |
| 2,654,438 | 10/1953 | Wintermute | 55/149 X |
| 2,796,845 | 6/1957 | Rendel | 55/149 X |
| 3,117,849 | 1/1964 | Selke | 55/149 X |
| 3,193,912 | 7/1965 | Polin | 55/149 X |
| 3,328,940 | 7/1967 | Steuernagel | 55/149 X |
| 3,540,191 | 11/1970 | Herman | 55/149 X |
| 3,740,927 | 6/1973 | Vincent | 55/123 |
| 4,440,552 | 4/1984 | Uchiya et al. | 55/149 X |
| 4,725,289 | 2/1988 | Quintilian | 55/149 X |

*Primary Examiner*—Richard L. Chiesa

*Attorney, Agent, or Firm*—Burns, Doane, Swecker & Mathis

[57] ABSTRACT

An electronic air cleaner includes discharging electrodes for charging dust particles with a polarity, and dust collecting electrodes of an opposite value for collecting the charged dust particles. The dust collecting electrodes are moved toward and away from the discharging electrodes to compensate for changes in electric current caused by various conditions such as a build-up of dust on the dust collecting electrodes. The current change is detected by a control unit which rotates a drive screw to displace the dust collecting unit.

5 Claims, 9 Drawing Sheets

ELECTRONIC AIR CLEANER

BACKGROUND OF THE INVENTION

1. Field of the Invention

The present invention relates to an automatic control type electrical air cleaner or dust collector.

2. Description of the Prior Art

A typcially conventional electrostatic precipitator is disclosed in U.S. Pat. No. 3,740,927, which comprises as shown in FIG. 1 a first section 20 having a plurality of negatively charged vertical wires W arranged between at least one or more pairs of positively charged vertical plates P1–P3 a second section 30 having a plurality of metallic girds G21 to G26 attached to the respective vertical plates in the first section 20. A corona discharge may be developed between the positively charged plates P1–P3 and the negatively charged W. The second section 30 abuts the end of the first section 20 and the grids G21–G26 thereof are parallel to each other. The first and last grids G21 and G2l are connected to a voltage source so as to prevent a corona discharge, and the remaining grids G22 to G25 are "floated" between the grids G21 and G26 so as to be charged by voltage induced toward the grids.

With this structure, particles of matter entering the second section 30 and traversing the openings of the respective grids will respond to the electric field between adjacent grids and to produce an aerodynamic flow pattern between the grids. As a result. there is an advantage that dust may be collected and removed from fluid medium, but there are problems in that the electrostatic precipitator is complicated and the manufacturing cost is expensive, and since the metallic grids are in a "floating state", the dust collecting efficiency is decreased.

Another conventional electrical dust collector, as shown in FIGS. 2(*a*), 2(*b*) and 2(*c*), includes a discharging electrode unit 3A having a plurality of sharp-edged projections defining electrodes 3 for forming local electric field 3, a dust collecting electrode unit 2A having dust collecting electodes for collecting the dust particles positively ionized by the discharging electrodes 3, and insulating supports 1 for maintaining a constant distance between the discharging electrodes and dust collecting electrodes to insulate therebetween. When the power voltage (not shown) is supplied to the dust collector under a condition that the electrode units 2A and 3A are fixed to the insulating supports 1, the discharging electrodes 3 are positively charged with electricity, while the dust collecting electrodes 2 are negatively charged, whereby an ionized field is formed between the discharging electrodes 3 and the dust collecting electrodes 2. As a result, if the air is introduced in the dust collector and passed through the ionized field, dust particles entrained in the air are ionized and charged positively and thus the positively charged dust particles are conducted by and collected onto the dust collecting electrodes. In this way, the dust collector performs a given air cleaning function.

With the construction as mentioned above, however, the dust collecting efficiency of the dust collecting electrodes 2 is largely variable on the basis of distance separating the dust collecting electrodes from the discharging electrodes, collecting voltage, temperature and humidity of the interior and exterior of the dust collector, speed of the air flow and amount of dust particles built-up on the dust collecting electrodes.

More particularly, since the electrical dust collector operation generally is classified into three selective air flow speeds, namely, high, medium and weak, the intensity of the air flow may change. And, since the temperature and humidity can vary during the year, it is necessary to be able to control the efficiency of the dust collecting electrodes.

In the conventional electrical dust collector, the collecting voltage for controlling the collecting efficiency cabn not be varied, and a distance separating the dust collecting electrodes from the discharging electrodes can not be effectively adjusted to vary the collecting efficiency. Accordingly, there are problems in that unexpected variation of the collecting efficiency due to the aforementioned factors can not be avoided.

SUMMARY OF A PREFERRED EMBODIMENT OF THE INVENTION

Accordingly, the present invention has been made in consideration of the above problems and an object of the present invention is to provide an automatic control type electrical dust collector in which dust collecting electrodes can be horizontally moved by means of a cross feed screw inserted in holes formed at regular intervals on a dust collection electrode unit for allowing the optimum collecting condition to be maintained always.

In order to achieve the above object, an automatic control type electical dust collector is arranged such that dust particles reaching the ionized field formed between the dust collecting electrodes and discharging electrodes, are ionized by the discharging electrodes and conducted toward the dust collecting electrodes to be thereby collected thereon, and the dust collecting electrodes and discharging electrodes are fixed and insulated by insulating supports, includes. A plurality of holes formed on the upper surface of the dust collecting electrodes receive a cross feed screw connected to feeding motor, wherein when a driving unit is operated on the basis of the compared value of an induced current concerning variation factors of the collecting efficiency detected by a signal detecting unit with a collecting reference current, the dust collecting electrodes are moved horizontally by the cross feed screw and adjusted so as to continuously maintain the optimum collecting efficiency, and an abnormal signal generating unit is operated in case of need of an abormal operating condition of the dust collecting electrodes which requires that the dust collector be shut off.

BRIEF DESCRIPTION OF THE DRAWINGS

Other features and objects of the present invention will become apparent from the following description of the preferred embodiment taken in conjunction with the accompanying drawings.

FIG. 2(*b*) is fragmentary front view of the conventional dust collector dipicted in FIG. 2(*a*);

FIG. 2(*c*) is a cross sectional view taken along the line 2C—2C of FIG. 2(*b*);

FIG. 3(*b*) is a side view of a discharging electrode unit according to the present invention;

FIG. 4(*b*) is a fragmentary perspective view of either one of upper and lower supports in which the discharging electrode units and the dust collecting electrode unit are mounted;

FIG. 4(*c*) is a fragmentary perspective view of either one of right and left supports in which the dust collecting elctrode unit is mounted;

FIG. 5(*b*) is a cross-section view taken along the line 5*b*—5*b* in FIG. 5(*a*);

FIG. 5(*c*) is a fragmentary side view of a vertical support depicting a split cylinder in which a driven screw is rotatably mounted;

FIG. 5(*d*) is a front view of FIG. 5(*c*).

DETAILED DESCRIPTION OF THE PREFERRED EMBODIMENT

Figure 1:
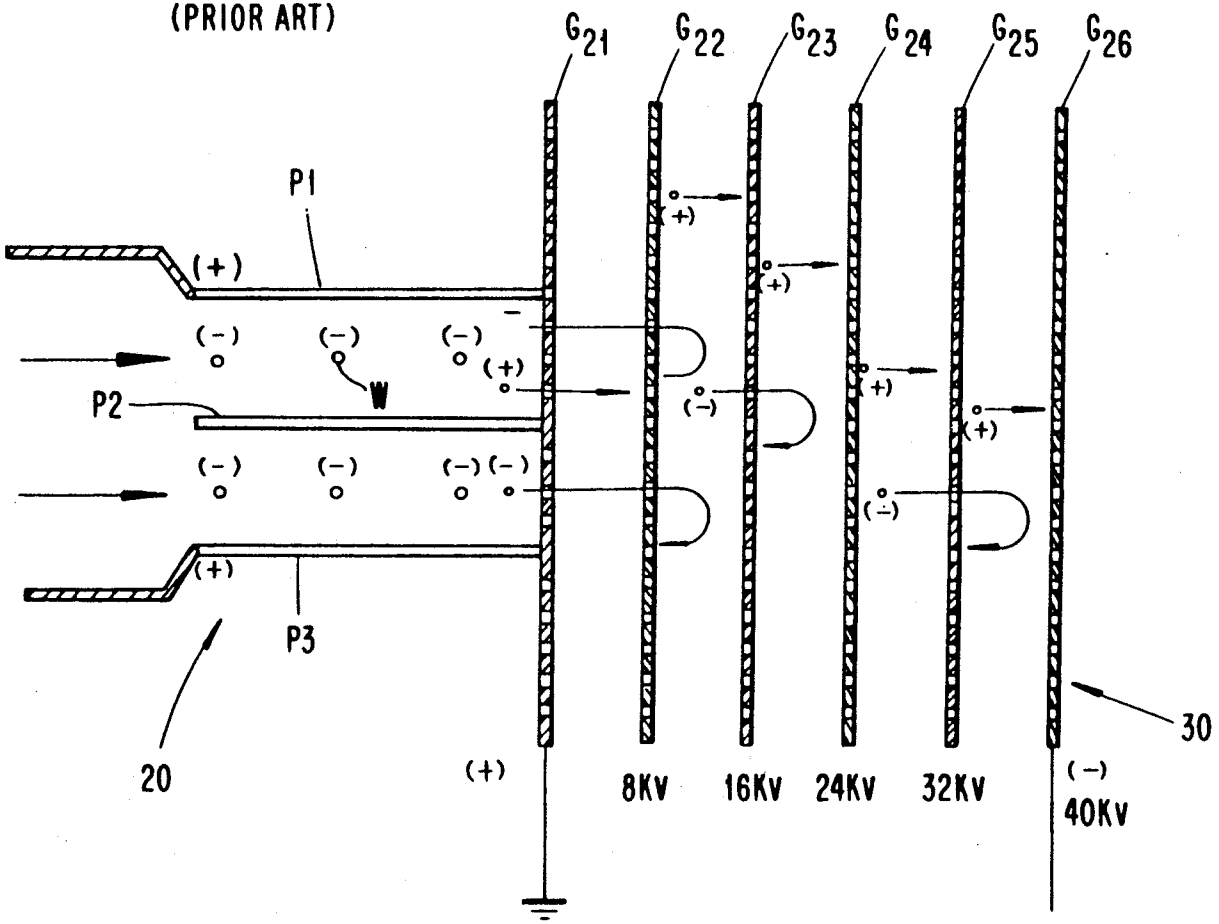
FIG. 1 (PRIOR ART)
FIG. 1 is a schematic view of a first conventional electrical dust collector.
Figure 2A:
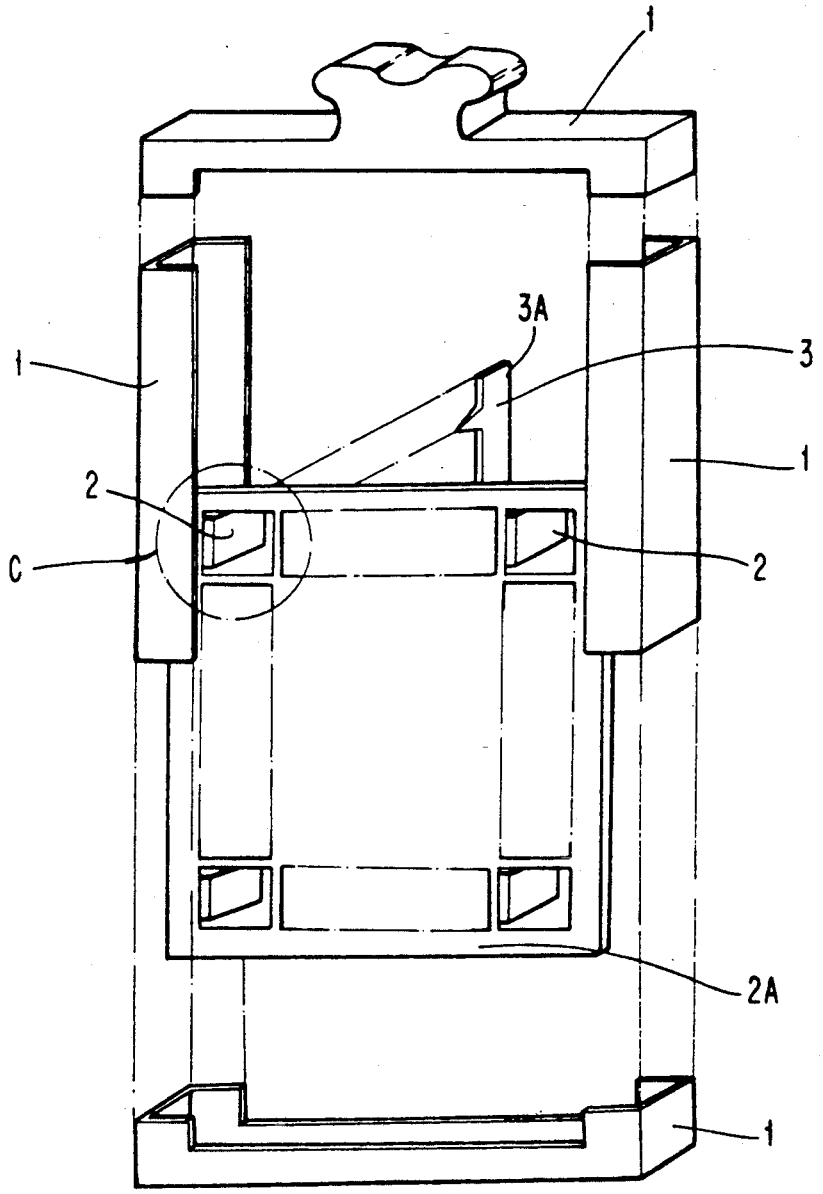
FIG. 2(a) (PRIOR ART)
FIG. 2(*a*) is an exploded schematic perspective view of a second conventional electrical dust collector.
Figure 2B:
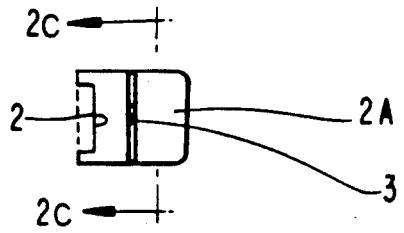
FIG. 2(b) (PRIOR ART)
Figure 2C:
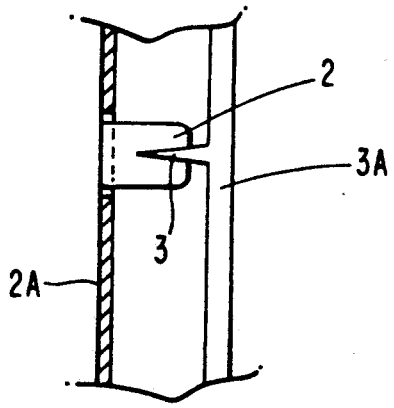
FIG. 2(c) (PRIOR ART)

A preferred embodiment of the present invention will be now described with reference to the accompanying drawings.

As will be explained hereinafter, a dust collecting electrode unit 6 is adjustably mounted to a frame which carries a discharging electrode unit 4. The dust collecting electrode unit 6 is adjustable to vary the spacing between electrodes 6A of dust collecting electrode unit 6 on the one hand, and discharging electrodes 5 of the discharging electrode unit 4 on the other hand. The adjustment is made automatically by a motor-actuated screw 9 to compensate for changes in electrical current as may be caused for example by dust build-up on the collector electrodes, or changes in temperature, humidity and/or air flow rate. Thus, a control unit 30 provides a measurement proportional to electric current and compares the measurement with a threshold value. When the meaurement differs from the threshold value by a predetermined amount, the screw is actuated to change the distance between the discharging and collector electrodes.

Figure 3A:
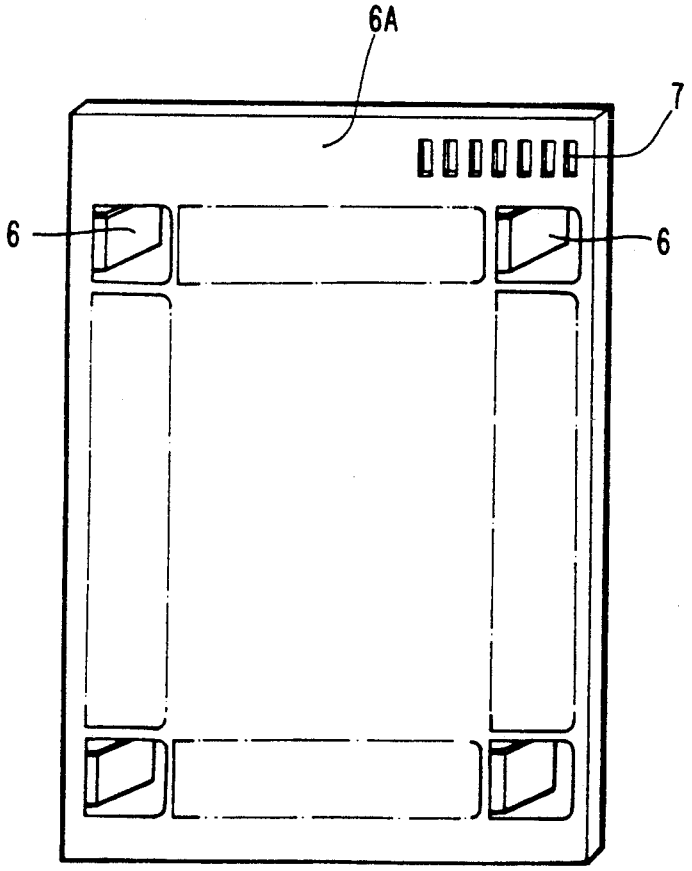
FIG. 3(*a*) is a front perspective view of a dust collecting electrode unit according to the present invention.
Figure 3B:
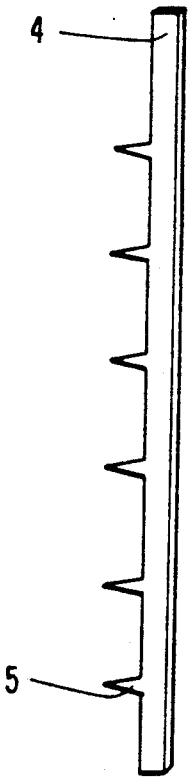
Figure 4A:
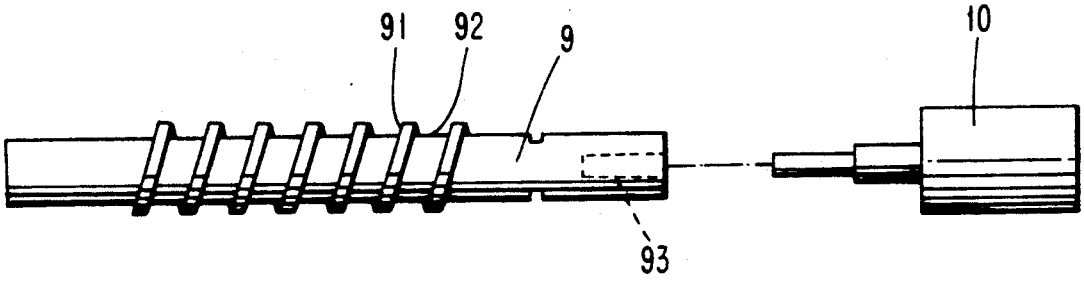
FIG. 4(*a*) is an exploded side view of a drive screw according to the present invention.
Figure 4B:
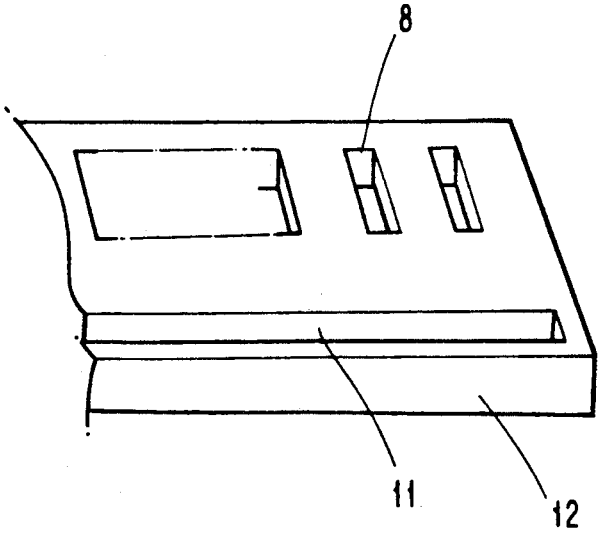
Figure 4C:
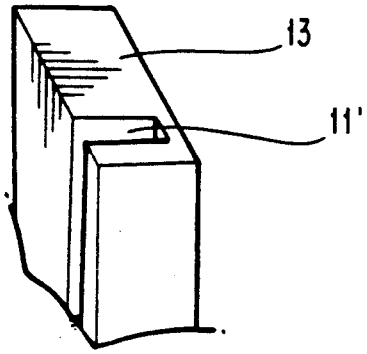
Figure 5A:
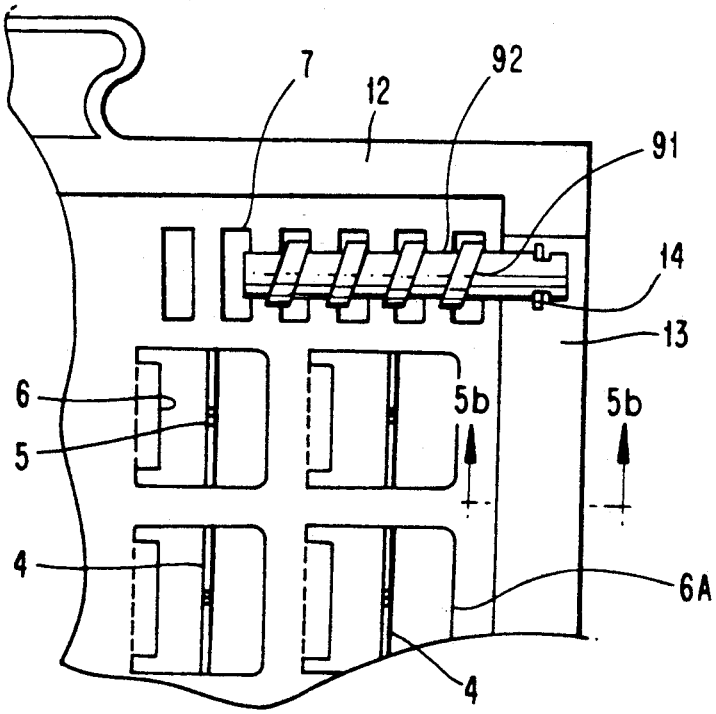
FIG. 5(*a*) is a fragmentary rear view of a dust collector according to the present invention.
Figure 5B:
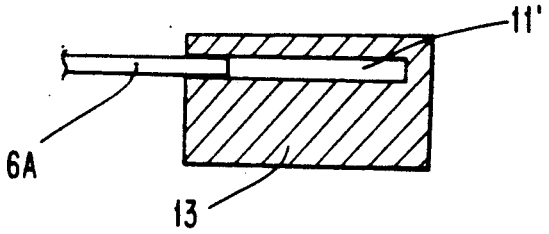
Figure 5C:
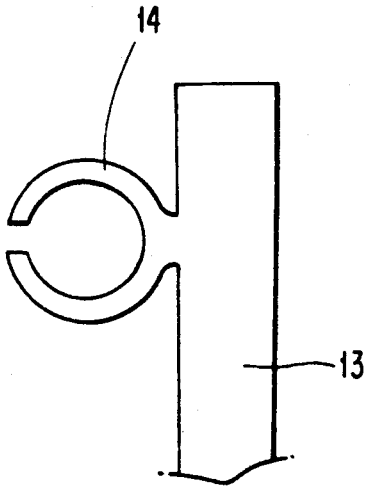
Figure 5D:
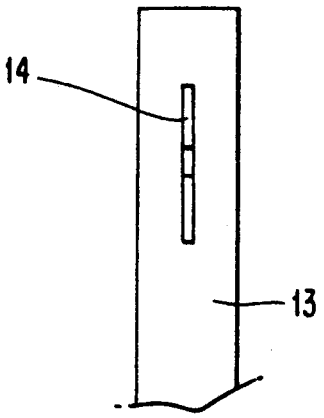
Figure 6:
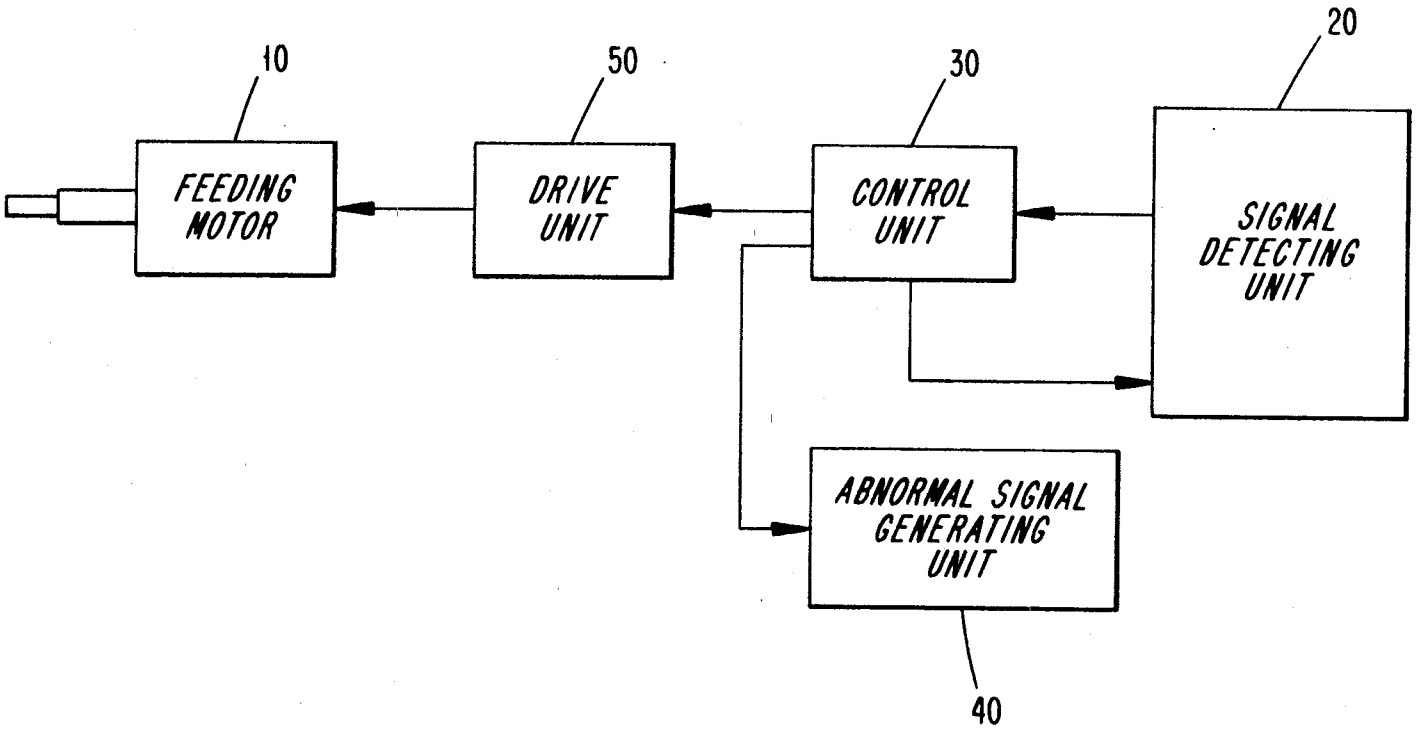
FIG. 6 is a block diagram of a control system of the dust collector according to the present invention; and, FIG. 7 is a flow chart of the operating sequence of the dust collector according to the present invention.
Figure 7:
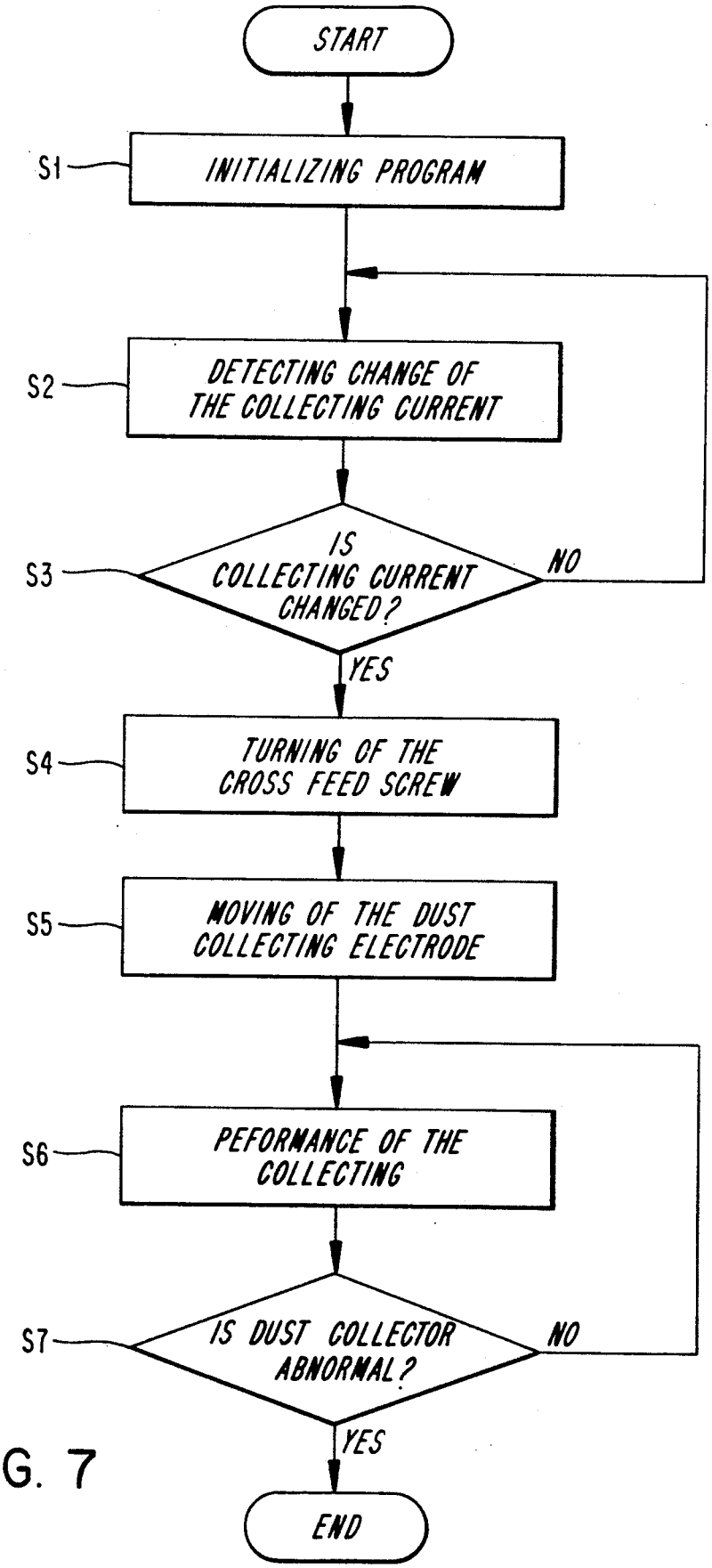

Referring to FIGS. 3 and 4, reference numeral 4 denotes a discharging electrode unit which is positively charged by D. C. power potential supplied thereto to ionize positively dust particles, introduced in the dust collector, with the use of a positive high voltage. The discharging electrode 4 has a plurality of sharp-edged discharging projections defining electrodes 5 for forming local electric fields to maintain the proper collecting efficiency without decreasing the ionizing efficiency. Numeral 6A denotes the dust collecting electrode unit which is negatively charged by the D. C. power potential and includes dust collecting electrodes 6 for collecting the dust particles ionized by the discharging electrode. A plurality of holes 7 are formed at regular intervals on the upper surface of the dust collecting electrode unit 6A. Numeral 9 denotes the cross feed screw which is inserted into the holes 7 so as to move horizontally the dust collecting electrode unit 6A when the screw is rotated. The cross feed screw 9 is provided with thread 91 and channel 92 and has at its one end a groove 93 with a predetermined depth.

Also, numeral reference 10 denotes the feeding motor whose output shaft is inserted and fixed in the feed screw groove 93 with a predetermined depth. The screw is capable of moving horizontally the dust collecting electrode unit 6A in accordance with the output of a drive unit 50. Numeral 12 denotes either of upper and lower insulating supports of the horizontal feeding groove 11 which receives an upper or lower edge of the dust collecting electrode unit 6A and enables that unit to be horizontally moved. The supports 12 also include grooves 8 for receiving the ends of a plurality of the discharging electrode units 4. Numeral 13 denotes either one of the right and left side vertical insulating supports having a vertical groove 11' for receiving a right or left edge of the dust collector electrode unit 6A and for allowing the electrode unit 6A to be moved horizontally. The supports 12 and 13 thus define a frame in which the discharging electrodes 5 are stationary, and the dust collecting electrodes 6 are movable relative to the discharging electrodes 5.

Moreover, the discharging electrode unit 4 and the dust collector unit 6A are disposed altenatively and provided with terminals to which are supplied the positive and negative potentials.

Next, the dust collector of the present invention will be described, referring to FIG. 5.

The feed screw 9 is rotatably mounted between two jaws formed by a split cylinder 14 which is affixed to the right hand support 13 (see FIS. 5(*c*) and 5(*d*)). When it is necessary to adjust the location of the dust collecting electrodes 6 relative to the electrodes 5, the feeding motor 10 is operated by a control unit 30 and the drive unit 50, whereupon the feed screw and thus the dust collecting electrodes 6 are moved because of engagement of the feed screw 9 with the holes 7, thereby maintaining effectively the proper collecting efficiency.

A power voltage, not shown, is supplied in order to operate the dust collector according to the present invention the operating being initialed at a step S1. After, the procedure is advanced to a step where the control unit 30 any change of the collecting current which changes may occur due to changes in ambient temperature, humidity, air flow rate and the amount of dust build-up on the collector unit 6A.

More particularly, upon the initial state of the dust collector, the temperature, humidity, amount of collected dust on the dust electrodes 6 and amount of air flow in the dust collector do not effect the collecting efficiency. Eventually, as dust particles are collected and accumulated on the dust collector electrodes 6, the electrical resistance of the dust collector is increased gardually. Hence the collecting current is changed and thus the collecting efficiency is varied.

The changed curent is detected continuously by the control unit 30 and that measurement is compared with a threshold value defined by a collecting current reference current value set in the control unit 30, at a step S3. If the changed current is different from the reference current value, that is, Yes, the control unit 30 determines that the dust collector is operting abnormally and proceeds to a step S4 to operate the drive unit 50.

Under control of the control unit 30, the drive unit 50 drives the feeding motor 10 to change the distance of the dust collecting electrodes 6 from the discharging electrodes 5, at a step S5 and then the dust collector performs the given dust ccollecting function, while maintaining the the optimum collecting efficiency.

Meanwhile, if the detected collecting current coincides with the reference current value at the step S3, that is the answer is No, the control unit 30 determines that the dust collector is operated normally and returns to the step S2 to detect the collecting current continuously.

And, when the dust particles are collected on the dust collecting electrodes 6 during execution of the function of the dust collector, whereby cleaning of the dust collecting electrodes 6 is needed or if other abnormal conditions occur which excessively affect the predetermined functions of the dust collector, that is the answer is Yes, at the step S7, an abnormal signal generating unit 40 including display means such as lighting lamp or buzzer, is operated to indicate the abnormal state so that a user can deactivate the dust collector. Alternatively, if the answer No is produced at step S7, the procedure is advanced to the step S6 and collecting function is performed continuously.

As described, according to the automatic control type electrical dust collector of the present invention, the feed screw is inserted into the hole formed in the dust collecting electrode unit 6A to allow the later to be moved horizontally and the feeding motor is operated by the drive unit controlled by the control signal from the control unit for preventing the efficiency from being undesirably decreased. The feed screw thus is driven by the motor to move the dust collecting electrodes, to maintain the optimum collecting efficiency.

While the present invention has been described with reference to a particular embodiment, it should be apparent to one skilled in the art that many changes and modifications may be made without departing from the spirit and scope of the invention as defined in the claims.

What is claimed is:

1. In an electronic dust collector for removing dust particles from an air flow, comprising:

electrical discharging electrodes positioned for electrically charging dust particles in the air flow with a polarity;

electrical dust collecting electrodes disposed at a distance from said discharging electrodes and being of an opposite polarity for attracting and collecting the charged dust particles, said electrical discharging electrodes and said electrical dust collecting electrodes being arranged such that said distance can be varied, driven means for varying said distance between said electrical dust collecting electrodes and said discharging electrodes, circuit means connectable to a power source for charging said discharge electrodes and said dust collection electrodes, and control means for providing a measurement proportional to electric current in said circuit means and comparing said measurement with a threshold value and actuating said driven means to vary said distance when said measurement differs from said threshold value by a predetermined amount.

2. Apparatus according to claim 1, wherein said dust collecting electrodes ate interconnected to form a dust collecting electrode unit, said unit being movable relative to said discharging electrodes.

3. Apparatus according to claim 2, wherein said driven means comprises a driven screw operably connected to said dust collecting electrode unit.

4. Apparatus according to claim 3, wherein said dust collecting electrode unit includes spaced holes arranged to receive respective turns of a thread of said screw.

5. Apparatus according to claim 1, wherein said control means senses an abnormal operational state of said dust collector, and provides a signal indicative of such a state.

* * * * *